US005634568A

United States Patent [19]

Wawrzyniak

[11] Patent Number: 5,634,568

[45] Date of Patent: Jun. 3, 1997

[54] FOREARM SUPPORTED TRAY

[76] Inventor: Greg Wawrzyniak, 11190 Poblado Rd., San Diego, Calif. 92127

[21] Appl. No.: 553,408

[22] PCT Filed: Mar. 28, 1994

[86] PCT No.: PCT/US94/03325

§ 371 Date: Jan. 22, 1996

§ 102(e) Date: Jan. 22, 1996

[87] PCT Pub. No.: WO95/26304

PCT Pub. Date: Oct. 5, 1995

[51] Int. Cl.[6] ..... B65D 1/36

[52] U.S. Cl. ..... 220/570; 220/23.83; 220/574; 206/1.7

[58] Field of Search ..... 220/570, 574, 220/23.83; 206/1.7, 1.8, 561

[56] References Cited

U.S. PATENT DOCUMENTS

| | | | |
|---|---|---|---|
| 2,511,537 | 6/1950 | Migdow | 206/1.7 |
| 2,515,703 | 7/1950 | Dumas | 206/1.7 |
| 2,669,736 | 2/1954 | Wabnitz | 220/570 |
| 2,738,606 | 3/1956 | Klein | 206/1.7 |
| 4,732,274 | 3/1988 | Bouton | 206/1.7 |
| 5,169,022 | 12/1992 | Elliott et al. | 220/574 |
| 5,353,952 | 10/1994 | Donche | 220/574 |
| 5,400,916 | 3/1995 | Weber | 220/570 |

*Primary Examiner*—Joseph M. Moy
*Attorney, Agent, or Firm*—Karl M. Steins

[57] ABSTRACT

A forearm supported tray (33) includes one or more compartments (37*a*, 37*b*), a corrugated roll-on area (50) and handle means (39, 42) allowing securement and control by hand or part thereof. The tray is designed to add convenience and improve safety when used for painting, touching-up or similar applications particularly those performed on hard to reach areas when using a ladder or similar means.

15 Claims, 2 Drawing Sheets

FOREARM SUPPORTED TRAY

BACKGROUND

This invention relates generally to trays and particularly to those constructed to be easily portable and adapted to carry a small cargo especially in form of paint and/or paint applicators.

Commonly used paint trays are designed to contain a certain amount of paint and to provide an area to distribute the paint evenly onto the paint roller. The size of those conventional paint trays is such, as to receive a large paint roller. However the size and shape of mentioned paint trays, especially when filled to capacity, does not allow them to be moved above ground without great risk of spill.

The common remedy to this problem, practiced among professionals and amateurs alike, is using a nearly empty paint can, paint can cover or a small container filled with paint when touching-up all the "hard-to-reach" places. However, this is not a solution, since accessing those "hard-to-reach" areas with a paint brush and a paint container in your hands, i.e. via a ladder, is not only very cumbersome but also very dangerous.

This shows that there is a great need for a paint tray, which in an ideal case, would not restrict hands at all.

SUMMARY

Accordingly, it is a general object of the present invention to provide a tray that is portable and light weight. It is a more particular object of the present invention to provide a forearm supported tray that is easy and safe to use.

It is a still more particular object of the present invention to provide a forearm supported tray that allows virtually unrestricted use of both hands under the conditions relating to painting "hard-to-reach" areas especially while using a ladder or similar means.

In accordance with the present invention, there is provided a tray to be held over the forearm, the tray comprises one or more compartments large enough to hold several ounces of paint and wide enough to receive a small paint roller and a medium size paintbrush.

Further, the tray comprises a corrugated roll-on area. Means is provided to secure the tray and to be controlled by a hand or part thereof to prevent uncontrolled movement of the tray in any direction.

The control means is either or both of a thumb ring attached to the tray or a handle for gripping by the fingers. The thumb ring extends forwardly of the tray and the handle depends downwardly from a top portion of the tray.

The compartments are preferably sufficiently deep to extend significantly below the bottom of the forearm, when the forearm is in place supporting the tray. The bottoms of the reservoir compartments are flat so that the tray can stand stably on a foundation and independently of external support when the forearm is removed from the tray. Both the reservoir compartments extend in depth about an equal distance from the forearm support.

The invention is further described with reference to the accompanying drawings.

DRAWINGS

DESCRIPTION

Figure 1:
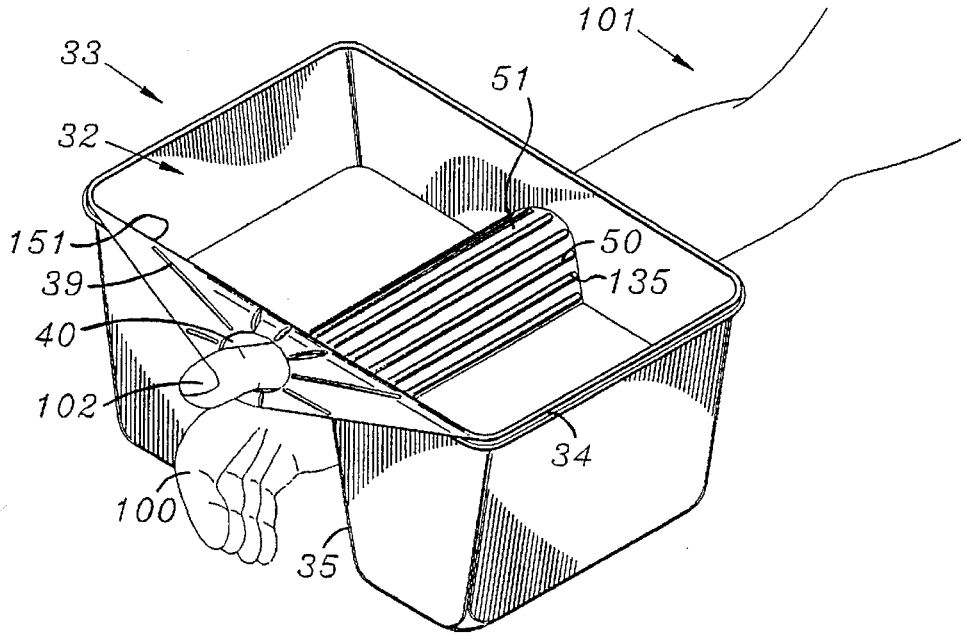
FIG. 1 is a perspective view of the forearm supported tray constructed comprising two symmetrical compartments and a thumb ring positioned on the forearm showing a virtually free hand.
Figure 2:
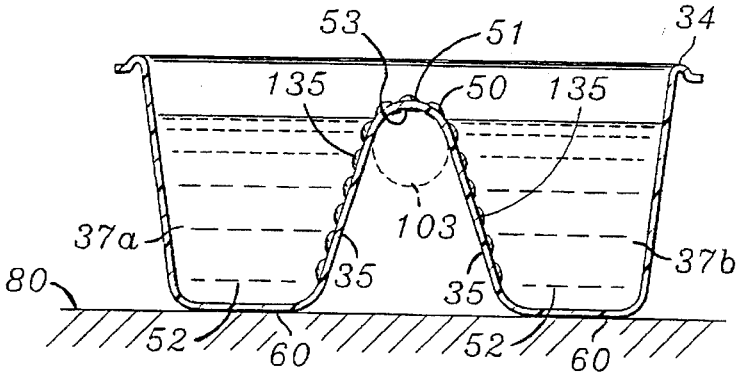
FIG. 2 is a section view of the forearm supported tray along section lines 2—2 in FIG. 1.
Figure 5:
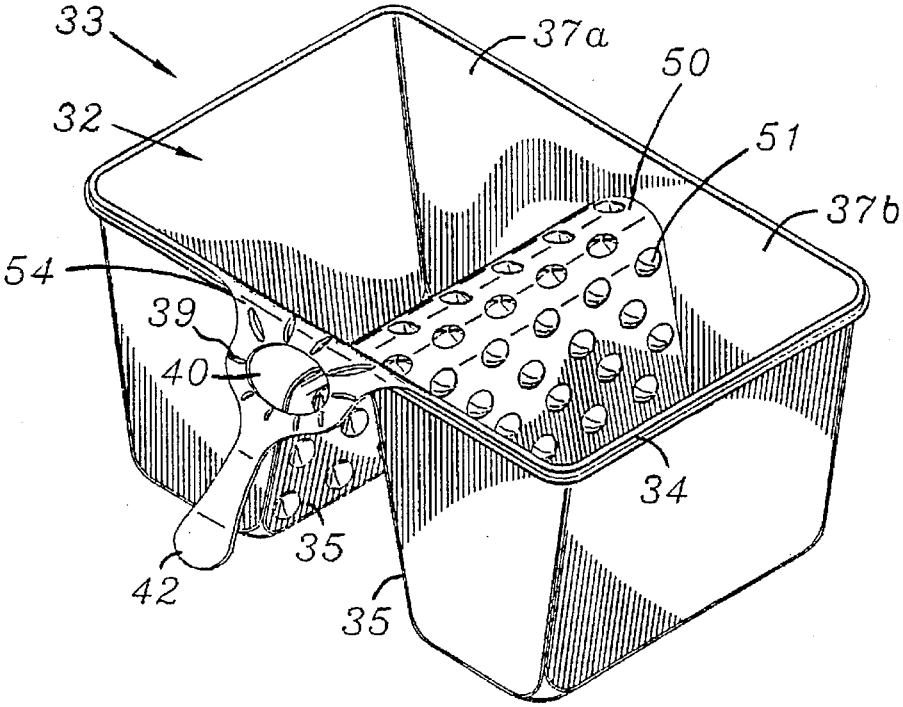
FIG. 5 is a perspective view of the forearm supported tray comprising two symmetrical compartments, a thumb ring and a handle.

FIGS. 1 and 5 show a perspective views of the forearm supported paint tray 33 resting on the forearm showing a virtually "unoccupied" or free hand 100.

The tray 33 includes two symmetrical tapered reservoir compartments 37*a* and 37*b* terminating upwards in a rim 34 which defines rectangular aperture 32. Interior corrugated walls of compartment 37*a* and 37*b* define an arch 35, which is shaped as a forearm support to rest on the forearm and forward portion of forearm 101. The outside portion 53 of the topmost portion of the arch 35 is generally rounded so that the top of the forearm can fit comfortably under the arch 53. The inside surface of the arch 35 provides a roll-on area 50 to the inside of the tray 33. The top 51 of the arch 35 is set below the level of the rim. Accordingly, paint or liquid 52 inside the compartments 37*a* and 37*b* can be transferred to the adjacent compartment without spilling over the rim 34.

A horizontal thumb ring 39 originates forwardly from and ahead of rim 34 medially on the forward end 151 of the tray 33. The thumb ring 39 is aligned with arch 35 and defines a centrally located aperture 40 sized to comfortably receive an average thumb 102 in order to secure and control the position of the tray 33 on the forearm and/or forward portion of forearm 101. A web construction 54 is provided to either side of the ring 39 to reinforce the connection of the ring 39 with the rim 34.

The preferred profile of compartments 37*a* and 37*b* provides a corrugated roll-on face of spaced ridges 135 to facilitate the action of a roller and/or brush in applying the correct amount of paint 52 to the roller or brush applicator. The depth of the compartments 37*a* and 37*b* is significantly greater than the diameter of an average adult-sized forearm as shown in phantom by line 103. The depth from the rim 34 to the base 60 is about three times the diameter of forearm 103. The height of the top 51 of arch 35 is about two and one-half times the diameter 103. About one-half diameter of forearm 103 extends above the top 51 to the rim 34. The base 60 for each compartment 37*a* and 37*b* is flat thereby facilitating the stable location of the tray 33 when the forearm 103 is removed.

Figure 3:
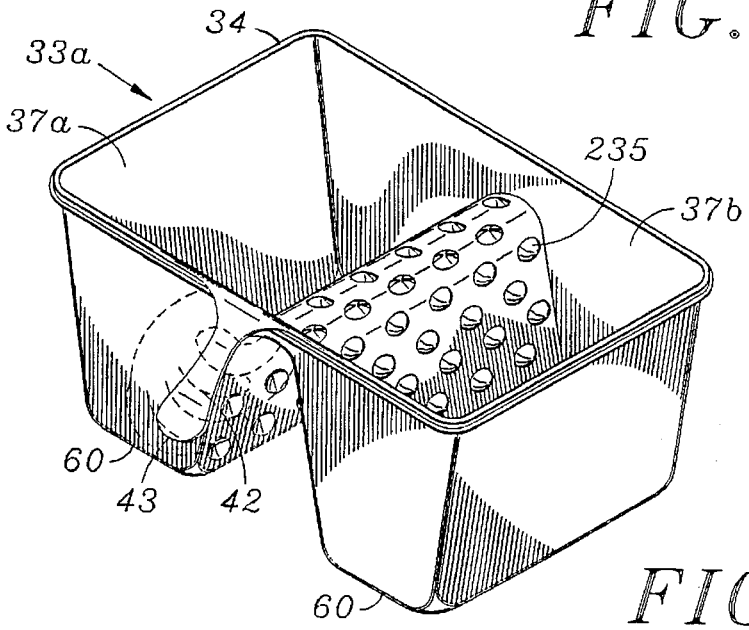
FIG. 3 is a perspective view of the forearm supported tray comprising two compartments and a depending handle.

FIG. 3 shows a perspective view of the forearm supported tray 33*a* with a downwardly depending handle 42 in place of thumb ring 39. The end 43 of the handle 42 is raised above the flat base 60 of each compartment 37*a* and 37*b*. The handle 42 extends forwardly of the front end 151 and ahead of rim 34. The tray 33 can be located on a foundation 80 when not supported by the forearm 103. The corrugated surface 135 in FIG. 3 are bumps 235 over the surface.

Figure 4:
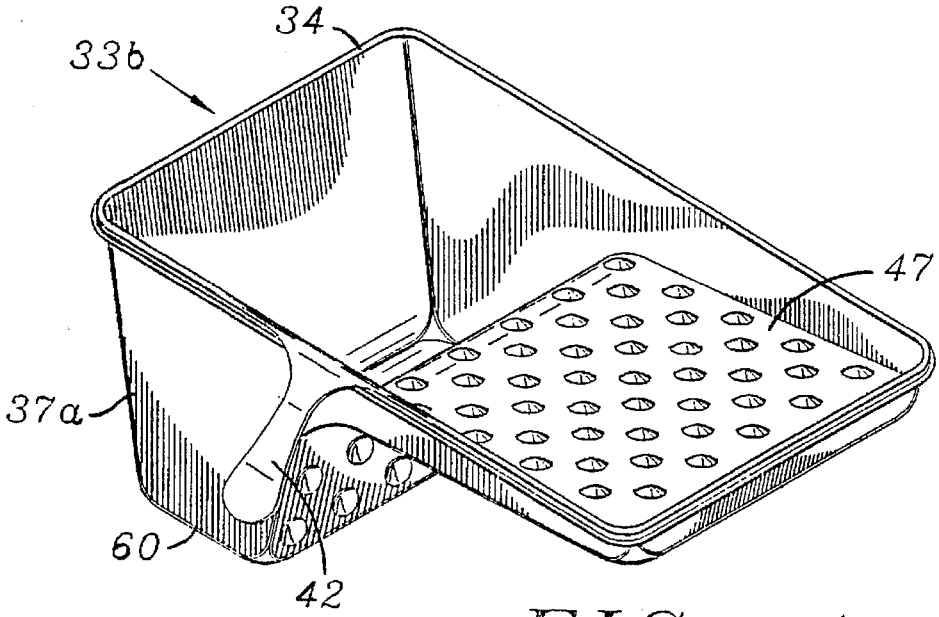
FIG. 4 is a perspective view of the forearm supported tray comprising a single compartment, flat roll-on area and a handle.

FIG. 4 shows a perspective view of the forearm supported tray 33*b* with single compartment 37*a*, a flat roll-on area 47 and handle 42 extending forwardly of the rim 34.

In FIG. 5 the embodiment of a tray 33*d* is shown with a thumb ring 39 and a forwardly depending handle 42. This provided for handling by the hand in either one or both modes, namely thumb ring and/or handle.

The forearm supported trays 33, 33*a*, 33*b*, 33*c* provide a portable, comfortable and easy to use device for painting and many other applications. Trays 33 and 33*a* can center the weight of the cargo over the forearm, thus lessening the strain on the hand and forearm muscles. Furthermore, the forearm supported tray literally frees the hands and increases safety when used for work on areas accessible by ladder or similar means. Also the paint application such as a brush and roller, can be contained in a reservoir, with the paint in the other reservoir, thereby facilitating use of the tray.

While the above description contains many specificities, these should not be construed as limitations on the scope of the invention, but rather as an exemplification of preferred embodiments.

Many other variations are possible. For example, the number and shape of compartments, various other means with which the tray can be secured by the hand, forearm or secured to the forearm, or other attachments like covers, handles are possible. The forearm support can be either on the lower portion of the arch or an additional member. By the term "forearm", the applicant means the wrist and/or arm of the user.

The scope of the invention should be determined not by the embodiments illustrated, but by the following claims.

I claim:

1. A paint tray comprising:

at least one reservoir for holding paint, the reservoir being sized to receive an applicator for removing paint from the reservoir;

a forearm support with the reservoir for resting at least partly on a forearm of a user, the reservoir being of a depth greater than the diameter of a forearm of a user; and an aperture extending forwardly of the reservoir and the forearm support for accommodating a thumb of the user whereby with the forearm support resting on the forearm of the user and the thumb of the user through the aperture, the reservoir is securely positioned relative to the forearm of the user.

2. The tray as claimed in claim 1, wherein there are two depending reservoirs, the reservoirs being located to either side of the forearm support, the reservoirs being directed downwardly an equal distance from the forearm support, whereby, when not supported on the forearm of the user, the reservoirs can stand stably.

3. The tray as claimed in claim 2, wherein the reservoirs each have a flat base and each include spaced upwardly and outwardly directed walls flared from the base, one of the upwardly flared walls for each reservoir being an inner wall of each reservoir merging with the forearm support.

4. A tray as claimed in claim 1, wherein the forearm support forms at least part of a wall for the reservoir, the forearm support and the wall being integral, and wherein the integral wall is at least partly corrugated.

5. The tray as claimed in claim 1, including a pair of reservoirs and wherein the forearm support is between the reservoirs and wherein the aperture extends forwardly from between the reservoirs.

6. The tray as claimed in claim 1, a webbing from the reservoir for reinforcing the connection between aperture and the rim.

7. A tray is claimed as in claim 1 wherein the one reservoir is for holding paint and the other reservoir is sized to receive an applicator for a moving paint from the reservoir.

8. The tray as claimed in claim 1, wherein the reservoir includes walls, and wherein the paint is held directly adjacent the surface of the walls.

9. A paint tray comprising:

a pair of spaced reservoirs for holding paint, the reservoir being sized to receive an applicator for removing paint from the reservoirs;

a forearm support between the reservoirs for resting at least partly on a forearm of a user, at least part of the reservoirs or forearm support being at least partly corrugated, the reservoir being of a depth greater than the forearm of a user; and an aperture extending forwardly of the reservoirs and the forearm support for accommodating a thumb of the user with the forearm support resting on the forearm of the user.

10. The tray as claimed in claim 9, including a web from the reservoir for reinforcing the connection with the aperture, the aperture extending forwardly of the forearm support.

11. The tray as claimed in claim 9, wherein the forearm support includes an arch for resting on the forearm of a user.

12. A paint tray comprising:

two spaced reservoirs for holding paint, the reservoir being sized to receive an applicator for removing paint from the reservoirs;

an arch between the reservoirs and extending below the top of the reservoirs whereby paint can be transferred between reservoirs without reaching the top of the reservoirs;

a forearm support rigidly affixed with the reservoirs for resting at least partly on a forearm of a User, such that reservoirs depend downwardly below the forearm of the user and the reservoirs each having a respective flat base for supporting the reservoirs stably on a foundation; and an aperture extending forwardly of the reservoir and the forearm support for accommodating a thumb of the user, whereby with the forearm support resting on the forearm of the user and the thumb of the user through the aperture, the reservoir is securely positioned relative to the forearm of the user when the reservoirs are raised from the foundation and supported on the forearm.

13. The tray as claimed in claim 12, wherein the aperture is formed to extend forwardly of the forearm support, and wherein the reservoirs extend to either side of the forearm support.

14. The tray as claimed in claim 13, including a web for reinforcing the aperture connection to the reservoirs.

15. The tray as claimed in claim 13 including a corrugated surface on at least a part of a wall of the reservoirs or the arch.

* * * * *